US005549528A

United States Patent [19]

Bryant

[11] Patent Number: 5,549,528

[45] Date of Patent: Aug. 27, 1996

[54] OCTOPUS SKIPPING ROPE DEVICE

[75] Inventor: Philip Bryant, Orange Beach, Ala.

[73] Assignee: Select Service & Supply Co., Inc., Atlanta, Ga.

[21] Appl. No.: 434,202

[22] Filed: May 3, 1995

[51] Int. Cl.[6] ..... A63B 5/22

[52] U.S. Cl. ..... 482/81; 482/148

[58] Field of Search ..... 482/81, 82; 119/786, 119/787, 788, 795, 797, 798, 799; 248/527, 525

[56] References Cited

U.S. PATENT DOCUMENTS

| | | | |
|---|---|---|---|
| 808,999 | 1/1906 | Luquire | 119/788 |
| 1,465,806 | 8/1923 | Chester | 119/786 |
| 1,830,193 | 11/1931 | Danner | 248/527 |
| 3,241,832 | 3/1966 | Miller . | |
| 3,263,995 | 8/1966 | Morrow . | |
| 3,329,380 | 7/1967 | Graves et al. | 248/527 |
| 3,595,571 | 7/1971 | Spinnett . | |
| 3,612,522 | 10/1971 | Ekonen . | |
| 4,637,606 | 1/1987 | Hunn . | |
| 5,167,599 | 12/1992 | Haller . | |

FOREIGN PATENT DOCUMENTS

| | | | |
|---|---|---|---|
| 2039705 | 8/1980 | United Kingdom | 119/795 |

*Primary Examiner*—Lynne A. Reichard
*Attorney, Agent, or Firm*—Browdy and Neimark

[57] ABSTRACT

An apparatus and method for skipping about a pole includes a collar slidably mounted on a vertical pole and means for clamping the collar at various heights. Around the collar are at least two attachments for skip (jump) ropes. The invention may use as attachments eye-bolts or the like screwed into threaded holes in the collar, with swiveling snap rings fastened to the inner ends of the ropes and clipped to the eyebolts with the skip ropes attached to the snap rings; in this embodiment the eyebolts act both as rope attachments and as clamping members. The eyebolts or rings may also be permanently attached to the pole. As many users as there are attachments may use the invention at once.

15 Claims, 2 Drawing Sheets

OCTOPUS SKIPPING ROPE DEVICE

FIELD OF THE INVENTION

The present invention relates to skipping devices having flaccid, hand-supported lines members swung in an arcuate path over the head and under the leaping feet of a user.

BACKGROUND OF THE INVENTION

Skipping rope, also known as jumping rope, is an exercise that can be practiced with simple and inexpensive equipment, for example a rope with handles at either end. Skipping can be done by a single individual or by several people. One or more persons can skip together within the arc of a single rope, swung by one or two others.

Two ropes may be swung simultaneously, as in the game of "Double Dutch." The two are swung in counter-rotating senses and 180 degrees out of phase, so that the skipping frequency is double that of the swinging (revolving) frequency of either rope. Typically one person swings two free ends of the skipping roper while another holds the opposite ends stationary. Double Dutch requires skill both for rope swingers and skippers. Skippers need skill especially for entering and exiting the space circumscribed by the double swinging ropes. Entering is known as "calling in."

For use with one hand by a single user, or for use with one skipping user and one rope-swinging user, it is possible to attach one end of a skipping rope to a handle and the other end to a wall. These attachments are shown in U.S. Pat. Nos. 4,736,945 to Vinciguera and 3,411,775 to Delk, Jr.

The prior art does not disclose the use of such single-ended rope attachments for use with Double Dutch or the like complex skipping exercises. Despite the great popularity of such exercises, the prior art has failed to provide any apparatus adapted to them, or enabling such exercises to be augmented or modified.

U.S. Pat. Nos. 3,612,522 to Ekonen, 5,167,599 to Haller, and 3,263,995 to Morrow, all show skip ropes attached to posts. Morrow shows in FIG. 5 a ring 33 attached to a post 29.

Height adjustments for single-handed skipping ropes are shown in the Haller patent in FIG. 3. U.S. Pat. No. 3,595,571 to Spinnett also shows adjustable height pedestals (in FIG. 1).

Several prior-art patents disclose swiveling rope attachments or bearings (eg., U.S. Pat. Nos. 554,992; 3,612,522; and 3,263,995). U.S. Pat. No. 4,637,606 to Hunn shows a swiveling snap-ring connector 5 used to attach a skip rope.

U.S. Pat. No. 3,241,832 to Miller shows a rotary skipping device with revolving jump bars 34 radiating from a hub. The bars 34 are revolved in a plane. No flaccid line or skip rope is disclosed by Miller. The bars 34 do not rotate about horizontal axes; instead, they revolve about a common vertical axis.

No pattern of skipping ropes is seen in the prior art, and nothing that could organize a plurality of rope skippers either for joint skipping, rope-to-rope skipping, or for enabling a large number of rope skippers to simultaneously use a restricted area.

The prior art does not teach any attachment of a skipping rope to a pole in a manner which utilizes the space around the pole efficiently. In those portions of the prior art that attach a rope to a pole, the pole could be replaced by a wall (or other rope end support) without affecting the use of the prior-art devices.

SUMMARY OF THE INVENTION

Accordingly, the present invention has an object, among others, to overcome deficiencies in the prior art such as noted above.

A particular object of the invention is to utilize ground or floor area effectively to accommodate plural rope skippers in a restricted area.

Another object is to permit new kinds of sequential rope skipping exercises or games.

Still another object is to economize on the number of poles that must be provided when several users are to skip with ropes attached to poles.

A further object is to provide height-adjustable attachment of skipping ropes to a pole that is both inexpensive and easily constructed from readily-available materials.

The invention thus provides an apparatus for users to perform rope skipping exercises adjacent a generally vertical pole around which a collar, having a through-opening adapted to accept the pole, is slidably mounted. The collar may be a section of pipe or tubing having an inner diameter just larger than the outside diameter of the pole. The collar includes clamping means for adjustably fixing the collar at various heights along the pole. A plurality of rope attachments are radially disposed around the exterior of the collar for attaching a plurality of skipping ropes to the rope attachments, so that users may skip with the ropes around the pole.

The attachments, and thus the ropes, are preferably arrayed at equal azimuthal angles (i.e., around the pole's axis) and hence the ropes are likewise able to be deployed at equal angles; this minimizes the amount of floor space needed.

The rope attachments may includes rings and are preferably eyebolts whose threaded shanks screw into mating holes in the collar. Thread locking means, such as Nylon inserts or lock nuts and lock washers, are preferably used to prevent the collar from loosening during use. The inner ends of the skipping ropes preferably have a ring hook coupled to the inner end of each rope for attaching it to the attachment rings of the collar. The ring hook may include a spring-loaded snap member for locking and demounting the ring hook to and from the rings. In addition, each ring hook may include a swivel between the ring hook and the inner end of the skipping rope. The outer end may include a handle for one of the users to grasp.

In an alternative embodiment, the collar may be omitted and the eyebolts screwed directly into the pole.

The present invention also contemplates a method or methods of skipping about a pole, in which allows the users to skip in various patterns.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Here, and in the following Specification and Claims:

"exercise" means any activity that involves skipping or skipping over a flaccid member passed under a user's feet, and includes sports, dances, games and contests;

"hook" includes any device adapted for removably coupling to a ring; and

"means for revolving" includes both mechanical- and human-powered means for revolving (swinging in arcs) a skipping rope.

Figure 1:
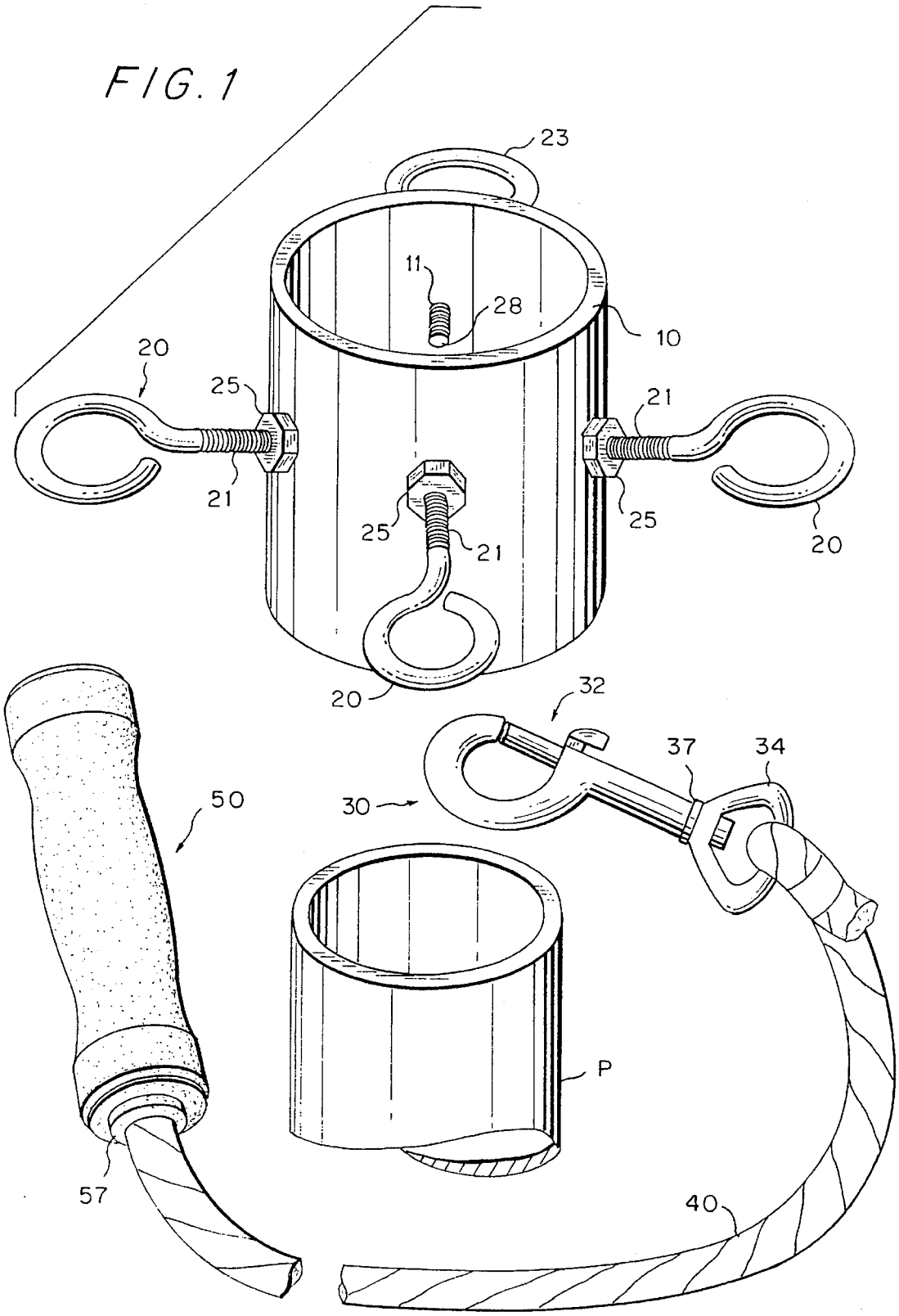
FIG. 1 is a perspective, partially broken and exploded, view of the present invention.
Figure 2:
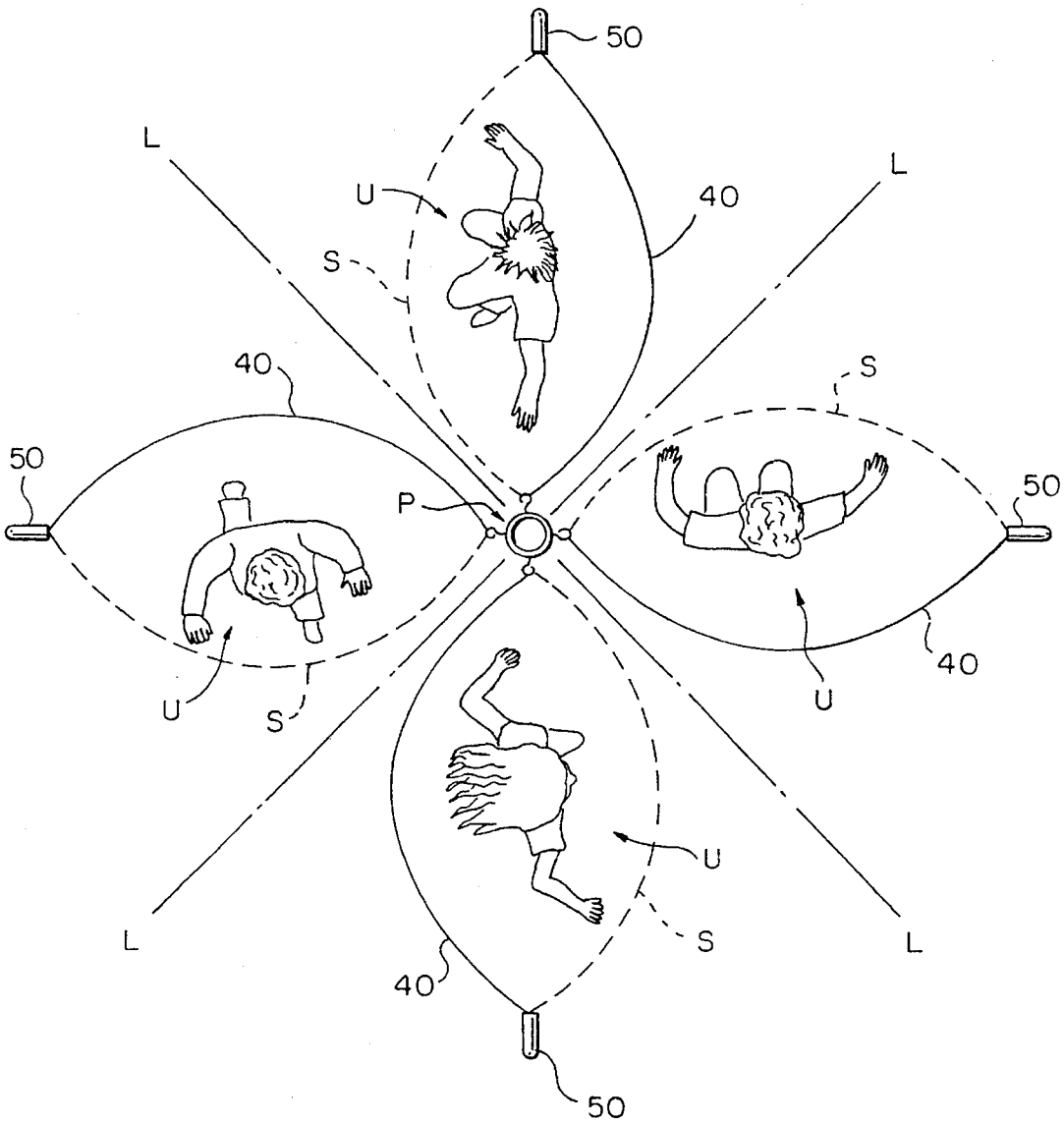
FIG. 2 is a plan view of users skipping with the present invention.

The present invention relates to an apparatus for radially disposing a plurality of skip ropes from a central pole, so that users may employ the radiating ropes either singly or jointly. FIG. 1 shows parts of the invention; FIG. 2 shows multiple users skipping with the invention.

FIG. 1 depicts a preferred embodiment of the present invention which employs a collar 10 that is slidably mounted onto a pole P. The collar 10 is preferably a section of thick-walled pipe or tubing having an inner diameter just larger than the outside diameter of the pole P. The pole P and collar 10 may also be of other forms, such as for example, both of square-section tubing. The pipe P may be solid or hollow as shown in FIG. 1.

The collar 10 includes a plurality of rope attachments 20 which are preferably disposed at equal azimuthal angles around the collar 10. The preferred attachment 20 is an eyebolt having an eye ring 23 and a threaded shank 21 which threads into a mating female threaded hole 11 through the collar 10. Locking nuts 25 are used to prevent the eyebolts from turning; equivalent means such as anaerobic thread-locking sealants and lock washers may also be used. The collar 10 may include nuts with anti-loosening nylon inserts welded or otherwise fastened to the collar 10. The eyebolts (or other rope attachment devices) may be permanently welded or adhered to the collar 10, or integrally formed with it. In general, any conventional means may be used that will provide rope attachments around the collar 10.

In the preferred embodiment shown, the eyebolts 20 have the double function of providing rope attachments and of clamping the collar 10 against the pole P to keep it at the desired height. The end 28 of three or more eyebolts 20 will bear against the pole P when the eyebolts 20 are threaded into the holes 11, after which the locking means prevent loosening.

The means for clamping the collar 10 at a selected height on the pole P may, alternatively, include separate means for adjusting the internal size of the collar, such as apparatus for band-tightening of a split collar 10 around the pole P, or a through-bolt (not shown) separate from the attachment eyebolts 20. If the clamping means is structurally separate from the attachments 20, then the eyebolts (or equivalent devices) may be welded onto the collar 10, or otherwise fixed.

The present invention also contemplates attachments permanently fixed to a pole P. Any conventional attachment structure or means may be employed.

The attachments need not include closed-loop eyes, but can also include partially-open hook-like devices, cleats, and other conventional attachments for ropes.

At each attachment 20 a skipping rope 40 may be attached. Preferably the inner end of each rope 40 is coupled to a swivelling snap hook 30 which includes a spring-loaded snap member 32 that prevents the hook 30 from falling off the attachment 20, a swivel 37, and a rope coupling eye 34.

The outer end of the rope 40 preferably includes a handle 50, which may optionally include a bearing 57.

FIG. 2 shows the present invention in use. Several skipping users U are shown skipping. The ropes 40 are turned by the handles 50, held by other users (not shown) in arcuate paths; the outline of the rope path is denoted by the dashed lines S. In FIG. 2, all four ropes 40 are in phase, so that the users all skip together.

The ground plane in FIG. 2 is shown divided into four quadrants by asymptotic lines L radiating from the pole P. The ropes 40, as they are swung, assume the same shape that cables of suspension bridges take on, a curve similar to a parabola with. Because of the relatively straight asymptotic end sections, the arcuate projections of the swung ropes on the ground plane (i.e., the four areas in FIG. 2 between the ropes 40 and the dotted shapes S) have a generally diamond-like shape.

The angle at the apex of the projections (where the rope 40 is coupled to the pole P) is determined primarily by the length of the rope 40 and secondarily by the height adjustment of the collar 10 and the height of the person (or machine) swinging the rope 40. The number of ropes 40 that may be arrayed about the pole P is thus, to a first approximation, a function of the length of the ropes 40. If only one-handed rope skipping (with the skipper also being the swinger) is practiced, the angle will be large and only two or three rope attachments 20 may be provided, as a design choice. If long ropes 40 are used, then four or more attachments 20 may be provided on the collar 10.

The advantages of the present invention result from the geometrical arrangement of the radiating ropes. These advantages are:

First: The circular array of the ropes 40 allows users to create new skipping activities which are analogous to, but even more challenging than, Double Dutch and the like exercises. The plural ropes may be turned at the same frequency (in synchronization or out of phase) by those swinging the ropes at the handles 50 (not shown). Because of the circular arrangement, one or more of the pictured skipping users may advance or retreat from rope to rope, "calling in" at each. The skipping users may continue this indefinitely because of the circular arrangement. (If the plural ropes were aligned along a wall as taught by the prior art, instead of radiating from a pole according to the present invention, then the skipping users would need to exit and re-enter the line of ropes periodically. Moreover, certain group calling-in games would be impossible.)

Second: The present invention allows many more skipping users to occupy a given floor or ground area than would otherwise be possible, because the generally diamond-shaped areas occupied by swinging ropes will fit together around a central common apex point (the pole P) with virtually no wasted space at the attached inner ends of the ropes.

Each pole can be assigned to a circular area and these circular areas arranged in staggered rows; this insures that adjoining circular areas will not interfere. This arrangement is much more space-conserving that the prior art contemplates.

Still greater efficiency can be achieved: ground area is also occupied by the swinging users (not shown) who hold the handles 50; the ground pattern, when the swinging users are included, is star-like. A star is another regular shape that can be arranged with like shapes to roughly "tile" the available area and so to maximize the number of skipping users in a limited space (as for example in a small gymnasium). In this configuration, the asymptotic lines L of FIG. 2 would be angled relative to adjoining poles P such that the swinging users of one pole P would stand on the asymptotic line L of the adjoining pole.

The pole-centered arrangement of the present invention allows much higher densities than can be accommodated by any means taught by the prior art, notably wall attachment of skipping ropes. The prior does not disclose multiple rope attachments arrayed along a wall, but, if it did, the spaces bordered by the wall and the asymptotes to the ground projections would be wasted space; moreover, interior areas distal the walls could not be utilized.

Third: The present invention requires less hardware and labor than is disclosed in the prior art for multiple skipping user. The collar 10 allows poles, provided for other uses and commonly found in playgrounds, to double as skipping apparatus.

Fourth: The height-adjustable collar 10 can be moved up and clamped at a safe height, away from children, when not in use. This avoids any danger from children running into the attachments.

The foregoing description of the specific embodiments will so fully reveal the general nature of the invention that others can, by applying current knowledge, readily modify and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An apparatus for users to perform rope skipping exercises adjacent a generally vertical pole, the apparatus comprising:

a collar having a through-opening adapted to slidably accept a pole therethrough;

clamping means for adjustably fixing said collar at a selected one of various height positions and at a fixed angular orientation along the pole; and a plurality of rope attachment means radially disposed about an exterior of said collar; and a plurality of skipping ropes attached at respective ones of said rope attachment means;

whereby the users may skip with the ropes.

2. The apparatus according to claim 1, wherein the rope attachment means are radially disposed at generally equal angular increments about an axis of the through-opening of the collar.

3. The apparatus according to claim 1, wherein the rope attachment means includes rings.

4. The apparatus according to claim 3, wherein the rings include eyebolts having respective threaded shanks, and the clamping means further includes threaded holes through the collar, the threaded holes including female threads adapted to mate with male threads of the threaded shanks.

5. The apparatus according to claim 4, further including thread locking means.

6. The apparatus according to claim 5, wherein the thread locking means includes lock nuts engaged with the threaded shanks.

7. The apparatus according to claim 1, wherein the rope attachment means includes rings and wherein each of the skipping ropes includes a respective rope inner end having a ring hook coupled to the rope inner end for joining the rope inner end to the ring.

8. The apparatus according to claim 7, wherein the each ring hook includes a spring-loaded snap member for locking and demounting the ring hook to and from the rings.

9. The apparatus according to claim 7, wherein each of the skipping ropes further includes a respective swivel disposed between the ring hook and the rope inner end.

10. The apparatus according to claim 1, wherein each of the skipping ropes includes a respective rope outer end having a handle coupled thereto for one of the users to grasp.

11. An apparatus for users to perform rope skipping exercises comprising, in combination:

a generally vertical pole;

a plurality of rope attachment means radially disposed about an exterior of the pole; and a plurality of skipping ropes;

whereby the skipping ropes may be attached at the rope attachment means and users may skip with the ropes;

wherein the rope attachment means includes ring eyebolts having respective threaded shanks, and the pole further includes threaded holes including female threads adapted to mate with male threads of the threaded shanks.

12. The apparatus according to claim 11, further including thread locking means.

13. The apparatus according to claim 12, wherein the thread locking means includes lock nuts engaged with the threaded shanks.

14. An apparatus for users to perform rope skipping exercises comprising, in combination:

a generally vertical pole;

a plurality of rope attachment means radially disposed about an exterior of the pole; and a plurality of skipping ropes;

whereby the skipping ropes may be attached at the rope attachment means and users may skip with the ropes;

wherein each of the skipping ropes includes a respective rope outer end having a handle coupled thereto for one of the users to grasp.

15. For a plurality of skipping users, a method of skipping about a pole comprising the steps of:

providing a generally vertical pole;

providing a plurality of skipping ropes for the skipping users, each of the skipping ropes including a respective handle coupled to a respective outer end thereof;

attaching a respective rope inner end of each of the skipping ropes to the pole at a respective one of a plurality of attachment points of the pole, the attachment points being disposed generally at a common height and distributed about the pole at generally equal angular intervals; and providing means for revolving respective ones of the skipping ropes in arcuate paths over the heads and under the leaping feet of the users;

whereby the users may skip.

* * * * *